US010125501B2

(12) United States Patent
Rossi et al.

(10) Patent No.: US 10,125,501 B2
(45) Date of Patent: Nov. 13, 2018

(54) COVE FLASHING BASE SUPPORT

(71) Applicant: Fusion Terrazzo Systems Incorporated, Bolton (CA)

(72) Inventors: Fred Rossi, Bolton (CA); Justin Westfahl, Mississauga (CA); Marcio Campos, Mississauga (CA); James Leitch, Mississauga (CA); George Fung, Maple (CA)

(73) Assignee: Fusion Terrazzo Systems Incorporated, Bolton (CA)

( * ) Notice: Subject to any disclaimer, the term of this patent is extended or adjusted under 35 U.S.C. 154(b) by 0 days.

(21) Appl. No.: 15/309,503

(22) PCT Filed: May 7, 2015

(86) PCT No.: PCT/CA2015/050405
§ 371 (c)(1),
(2) Date: Nov. 8, 2016

(87) PCT Pub. No.: WO2015/168796
PCT Pub. Date: Nov. 12, 2015

(65) Prior Publication Data

US 2017/0183879 A1 Jun. 29, 2017

(30) Foreign Application Priority Data

May 8, 2014 (CA) ..... 2851474

(51) Int. Cl.
*E04F 19/04* (2006.01)
*E04F 15/10* (2006.01)
(Continued)

(52) U.S. Cl.
CPC ..... *E04F 19/0486* (2013.01); *E04F 15/10* (2013.01); *E04F 19/0481* (2013.01);
(Continued)

(58) Field of Classification Search
CPC . E04F 19/0486; E04F 19/0481; E04F 19/064; E04F 2013/063
See application file for complete search history.

(56) References Cited

U.S. PATENT DOCUMENTS 1,250,594 A * 12/1917 George ..... E04F 19/0436 52/288.1
2,307,338 A * 1/1943 Sluyter ..... E04F 19/0495 52/288.1

(Continued)

FOREIGN PATENT DOCUMENTS

EP 2110493 10/2009
GB 2031478 A * 4/1980 ..... E04F 19/0436

(Continued)

*Primary Examiner* — Babajide A Demuren
(74) *Attorney, Agent, or Firm* — Boyle Fredrickson S.C.

(57) ABSTRACT

The present invention relates to a polymeric cove base support for installation where flooring meets a wall, comprising extruded straight portions and molded exterior corner and end portions. The cove base support comprises an upper wall portion, a lower toe portion and an intermediate curved or concave cove. The wall portion is substantially perpendicular to the toe portion. The curved cove comprises an outer cove surface for facing the wall-floor interface and a spaced apart inner curved cove surface facing the room when installed. The spacing between the two curved coves for the straight portion creates an open area, where the open area includes a supporting or reinforcing bar juxtaposed between the curves, preferably positioned perpendicular between the two curve coves in the center region of the open area, and extending the length of the cove base. The corner and end portions have outside surfaces facing the wall and a floor, the outside surfaces defined in part by spaced ribs extending perpendicular to each of the toe and wall portions.

20 Claims, 11 Drawing Sheets

(51) Int. Cl.
*E04F 19/06* (2006.01)
*E04F 13/06* (2006.01)

(52) U.S. Cl.
CPC ..... *E04F 19/064* (2013.01); *E04F 2013/063* (2013.01); *E04F 2019/0422* (2013.01)

(56) References Cited

U.S. PATENT DOCUMENTS 2,994,905 A * 8/1961 Franker, Jr. ..... E04F 19/0495 16/16
4,052,830 A * 10/1977 Smith ..... E04F 19/04 52/288.1
4,829,730 A * 5/1989 Zeilinger ..... A47K 3/001 52/287.1
6,324,799 B1 * 12/2001 Salvitti ..... E04F 19/045 52/287.1
7,793,469 B2 * 9/2010 Murphy, Jr. ..... B29C 47/0019 52/177
7,866,102 B2 * 1/2011 Meahl ..... E04F 19/04 52/287.1
8,171,685 B2 * 5/2012 Harrison ..... E04F 19/022 52/254
2002/0157325 A1 * 10/2002 Domanico ..... A47K 3/008 52/35
2005/0011159 A1 * 1/2005 Standal ..... B28B 1/14 52/716.1
2005/0055936 A1 * 3/2005 Murphy, Jr. ..... B29C 47/0019 52/506.01
2006/0053712 A1 * 3/2006 Norton ..... E04F 13/06 52/287.1
2007/0006545 A1 1/2007 Johnston
2008/0066404 A1 * 3/2008 Beard, Jr. ..... E04F 19/0486 52/287.1
2008/0083179 A1 * 4/2008 Riggs ..... E04F 13/06 52/287.1
2008/0134602 A1 6/2008 Schick
2008/0172962 A1 7/2008 Harrison
2008/0172963 A1 7/2008 Harrison
2010/0281798 A1 * 11/2010 Sondermann ..... E04F 19/0481 52/288.1
2011/0094174 A1 * 4/2011 Meahl ..... E04F 19/04 52/288.1
2011/0192101 A1 8/2011 Johnston et al.
2013/0145706 A1 * 6/2013 Norton ..... E04F 13/06 52/287.1

FOREIGN PATENT DOCUMENTS

GB 2096665 A * 10/1982 ..... E04F 19/0495
GB 2504485 B * 9/2014 ..... E04F 19/0486

* cited by examiner

COVE FLASHING BASE SUPPORT

TECHNICAL FIELD

The present disclosure relates to supports used in cove flashings and in particular an extruded polymeric cove base support configured to be installed where a floor meets a wall and a method for making cove flashings.

BACKGROUND

In laying resilient floor coverings it is desirable to provide a cove flashing that matches the resilient floor covering. Cove flashings are used to create a transition between surfaces such as between a floor surface and a vertical surface such as vertical wall which intersect at a seam. Where the flooring covering applied to the floor surface is comprised of resilient sheet flooring such as vinyl or similar resilient materials, cove flashings provide a neat appearance at the wall and floor interface. Cove flashings also permit easier cleaning at the interface; thus reducing breeding grounds for bacteria and other microbial matters.

A cove flashing is generally curved and formed by running the edge of resilient sheet flooring up the wall for several inches. The resilient flooring must be supported in the curved portion to prevent punctures from feet, furniture, and other movable objects. Cove flashings may be prefabricated in 8 to 10 foot lengths, typically comprised of a section of resilient sheet flooring affixed to a cove base support. Alternatively, cove flashings may be fabricated on-site during the installation of the resilient flooring. A base support is installed against the wall and floor interface and resilient flooring extends over the base support up the wall to form a seamless cove flashing.

A typical cove flashing will have a 4 inch riser height (riser being on the wall) and a 3 inch toe width (toe being on the floor), although dimensions up to 12 inches may also be used in certain applications.

Existing cove base supports for creating cove flashings include continuous puncture resistant curved aluminum reinforcements and continuous synthetic rubber reinforcements.

One common method is to use prefabricated cove flashings. The prefabricated cove flashing comprises a continuous curved aluminum reinforcement affixed to a specified flooring sheet portion matching the sheet flooring. The prefabricated cove flashing sections are typically made 8 to 10 feet lengths. The prefabricated cove flashings are installed on site at the wall-floor interface using known adhesive or bonding agents. The top edge of the riser may be fitted with a continuous cove cap to provide a smooth top finish. Cove caps may be made of metal or other rigid materials. Once the cove flashing is in place, the edge of the flooring sheet on the floor or floor substrate is placed against the toe edge and the seam between the two edges is heat or chemically welded.

This method of using prefabricated cove flashings is inefficient and costly because it results in multiple handling of the prefabricated cove flashing and incurrence of shipping costs. If a cove flashing is specified to match the sheet flooring pattern, the sheet flooring pattern must be selected and shipped to the cove flashing fabrication facility. This method also results in a seam at the juncture between the sheet flooring and the cove flashing. The Aluminum base supports in cove flashings have also been known to corrode.

Aluminum base supports must have thicknesses sufficient to rigidly support the resilient flooring.

Continuous synthetic rubber base supports are easier to cut to length and install on site and are without corrosion problems. However, they are viewed as less durable than metal base supports and are not significantly less expensive than metal base supports.

It is an object to provide a utilitarian, resilient, and economical contoured cove flashing base support for use with resilient floor covering. "Cove flashing base support" is also referenced hereafter as "cove base support". The cove base support is suitable to form a curved or contoured connection between the floor covering and wall. The cove base support is capable of being readily cut and installed at the juncture of the wall and floor.

A further object is to provide a system comprising cove base supports, an outside corner cove base support and transition cove base supports.

SUMMARY

In one embodiment, the disclosure describes a cove base support having a wall portion, a toe portion and a curved intermediate cove portion operatively connecting the wall portion to the toe portion and comprising an open web structure.

In another embodiment, the disclosure describes an elongate extruded polymeric cove base support of uniform cross-section to be installed where a floor meets a wall. The cove base support comprises a wall portion for attachment to a wall adjacent a floor, a toe portion for attachment to the floor adjacent the wall, and a curved intermediate cove portion operatively connecting the wall and toe portions, having an outer wall and a spaced apart inner wall and a longitudinally extending member operatively connecting said outer wall and said inner wall.

In a further embodiment, the disclosure describes a cove base support in combination with a contoured outside corner section adapted to cooperatively join two lengths of said cove base support at an outside corner. The corner section comprises a first body and a second body perpendicular to and operatively connected the first body. Each of the first and second bodies has a wall portion, a toe portion and an intermediate curved cove portion. The wall portions have a substantially planar outside surface operatively connected to the curved outside surface of the cove portion. A plurality of spaced apart ribs are disposed perpendicular to the toe portion between the inner and outer walls of the cove portion and the inner and outer walls of the toe portion to define interior channel segments. The outside edges of the ribs in the toe portion form part of the outside surface of the toe portion.

In another embodiment, the disclosure describes a cove base support including a contoured end section adapted to cooperatively join a length of the cove base support to and form a transition with a vertical opening. The end section comprises a wall portion, a toe portion and an intermediate cove portion. The wall portion has a substantially planar upper outside surface cooperating with a plurality of spaced apart ribs disposed perpendicular to the toe portion between inner and outer walls of the cove portion and inner and outer walls of the wall portion to define interior channel segments. The outside edges of the ribs in the wall portion form part of the outside surface of the wall portion. The wall of the toe portion is dimensioned to form an angled edge relative to the intermediate cove portion from the end adjoining the cove base support to the end adjoining the vertical opening

BRIEF DESCRIPTION OF THE DRAWINGS

The present invention may be further understood by reference to the description of the embodiments, taken in conjunction with the accompanying drawings, in which.

DETAILED DESCRIPTION

Figure 1:
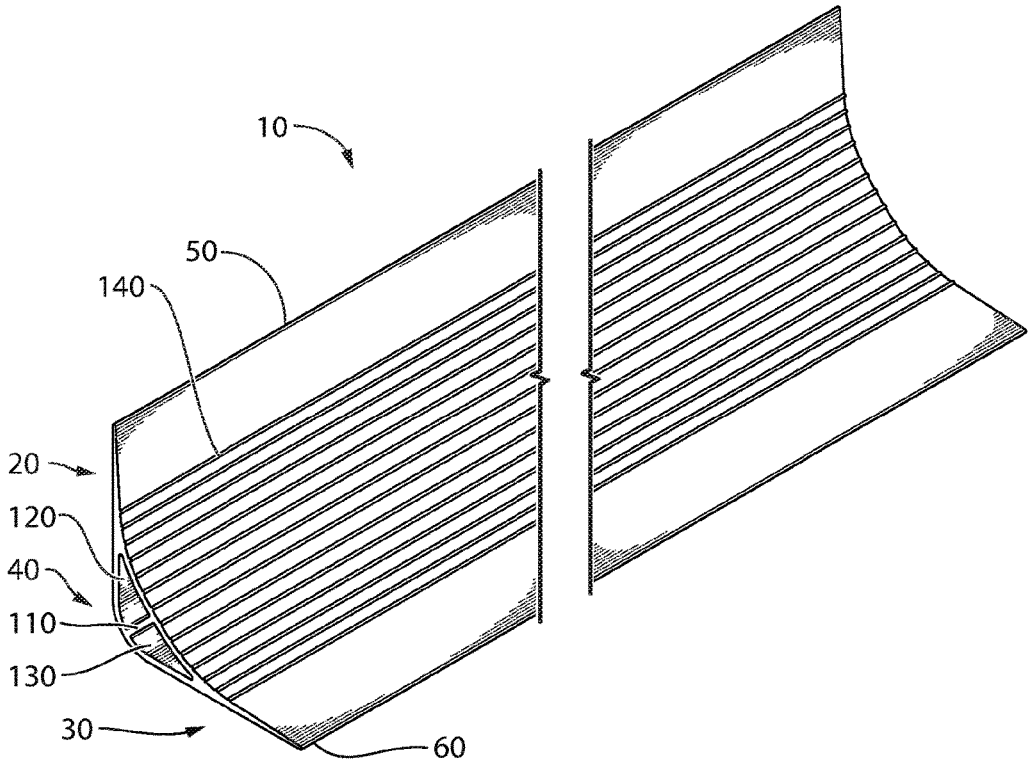
FIG. 1 is a perspective view of a section of a cove base support according to the principles of the present invention.
Figure 2:
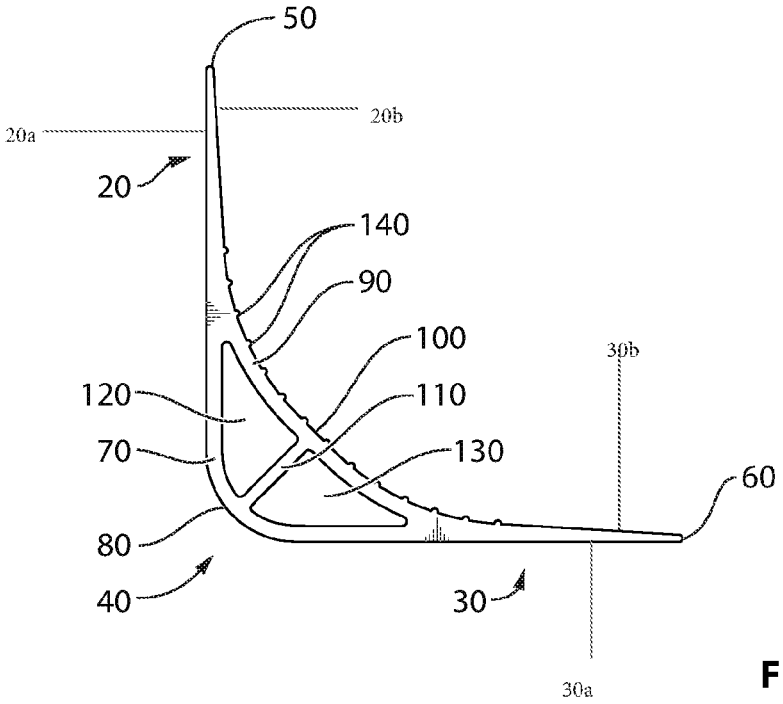
FIG. 2 is a cross section side view of the cove base support in FIG. 1.

For purposes of description herein, the terms "upper", "lower", "right", "left", "rear", "front", "vertical", "horizontal" and derivatives thereof shall relate to the invention as oriented and FIGS. 1 and 2. However, it is to be understood that the invention may assume various alternative orientations and step sequences, except where express lease specified to the contrary.

It is also to be understood that the specific devices and processes illustrated in the attached drawings, and described in the following specification, are simply exemplary embodiments of the inventive concepts. Hence, specific dimensions and other physical characteristics relating to the embodiments disclosed herein not to be considered as limiting.

Figure 3:
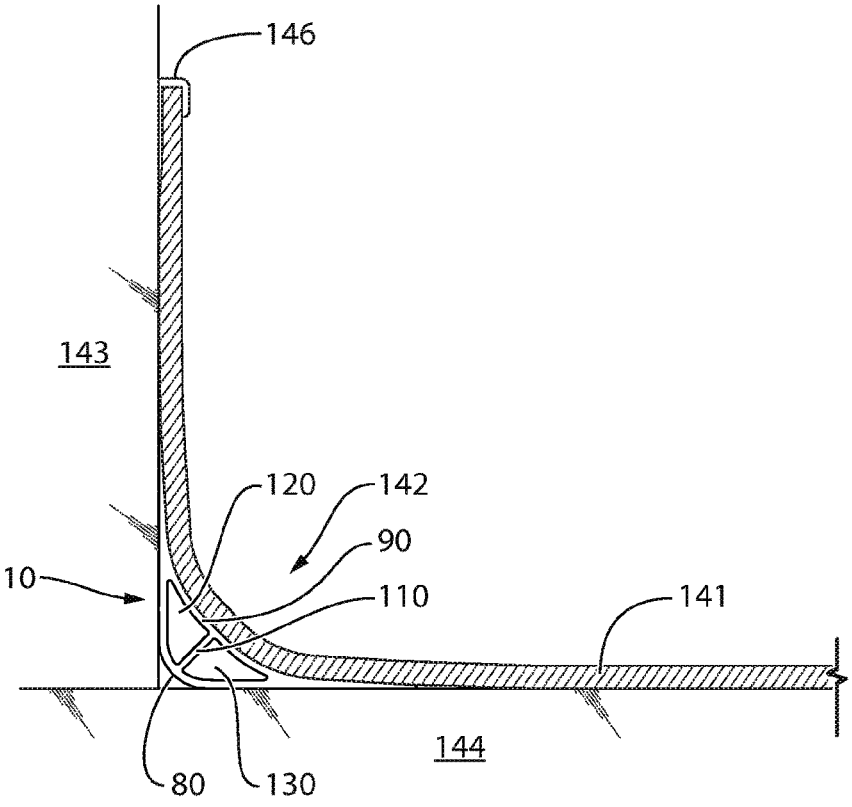
FIG. 3 is a side elevation cross section view of an installed cove flashing having the cove support of FIG. 1.
Figure 4:
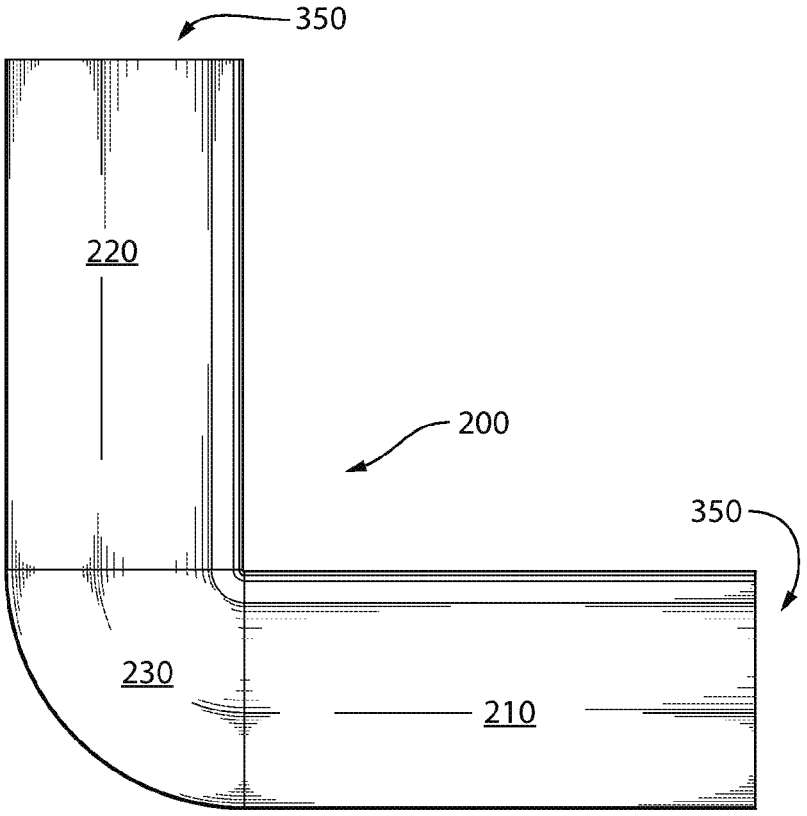
FIG. 4 is a top view of a molded outside corner section cove base support.

FIGS. 1, 2 and 3 depict a first embodiment of an elongated polymeric cove base support 10 (shown shorter than a standard length). Cove base support 10 may be fabricated by extrusion and may be constructed from polymeric material including PVC, ABS, polypropylene, high density propylene, and polystyrene. Cove base support 10 may be made or cut into 8 and 10 foot lengths. The cove base support 10 is configured to be installed where flooring meets the wall (also referred to as the wall-floor interface).

The cove base support 10 is of substantially uniform cross-section and comprises a wall portion 20, a toe portion 30 and a curved or concave intermediate cove portion 40. The wall portion 20 is substantially perpendicular to the toe portion 30. The wall portion 20 is installed parallel to a wall surface and the toe portion 30 is adjacent and installed parallel to a flooring surface. Wall portion 20 has an outer surface 20*a* facing the wall-floor interface when installed and an inner surface 20*b* facing the interior of a building space or room when installed. The thickness of wall portion 20 preferably tapers towards an edge 50. Toe portion 30 has an outer surface 30*a* facing the wall-floor interface when installed and an inner surface 30*b* facing the interior of a building space or room when installed. The thickness of toe portion 30 preferably tapers towards an edge 60. Tapering towards the edges provides a smoother transition when floor covering is installed on cove base support 10.

Curved cove portion 40 comprises an outside wall 70 having an outer surface 80 facing the wall-floor interface when installed and a spaced apart inside wall 90 having an inner surface 100 facing the interior of a building space or room when installed. Outside walls 70 and inside wall 90 are separated by a longitudinal web member or bar 110 comprising channels 120 and 130 between walls 70 and 90. Bar 110 is preferably disposed substantially perpendicular to walls 70 and 90 near the center region between walls outside wall 70 and inside wall 90. Bar 110 extends longitudinally the entire length of cove base support 10 to form an open web like structure within the curved wall portion 40 of cove base support 10. The structure provides rigidity whilst preserving the ability to construct a lightweight cove base support of uniform cross section. The radius and arc of outer surface 80 is less than the radius and arc of inner surface 100. This allows outer surface 80 to be positioned closer to a wall. The larger arced inner surface 100 creates a greater receiving surface for resilient flooring.

Inner surface 100 may be optionally provided with a plurality of longitudinal ridges 140. Ridges 140 provide additional surface areas for better adhesive bonding and the spaces between ridges 140 accommodate any excess adhesive that may be applied to cove base support 10 during installation of the cove flashing.

Cove base support 10 may be installed onsite. FIG. 3 depicts installed resilient sheet flooring 141 forming a cove flashing 142 over cove base support 10. A typical installation comprises the following steps. Cove support 10 in standard lengths or cut onsite as needed is installed at the wall-floor interface using adhesive. Known adhesives or bonding agents are used to affix wall portion 20 of the cove base support 10 to building wall 143 and the toe portion 30 to a floor surface 144. A resilient floor sheeting 145 is affixed to the floor surface 144, cove base support 10, and building wall 143 using known methods with the edge of the sheet flooring run up building wall 143 for several inches over the inner surfaces of the toe, curved cove and wall portions of the cove base support. A continuous cove cap 146 may be installed at the top edge of the flooring sheet extended up the wall. The installation of a cove cap provides a downward force on the resilient sheet flooring for improved adhesion to the cove base, wall and flooring and also provides a finished upper edge of the cove flashing. The result is resilient sheet flooring with a seamless cove flashing.

FIGS. 4, 5, 6 and 7 depict an outside corner cove base support section 200 that may be used in combination with cove base support 10. The outside corner section 200 comprises and first body 210 and a second body 220 adjoined at right angles to first body 210 thereto by an intermediate section 230. Each body portion comprises a wall portion 240, a toe portion 250 and an intermediate curved or concave cove portion 260. The wall portion 240 is substantially perpendicular to the toe portion 250. The wall portion 240 is installed parallel to a wall surface and the toe portion 250 is adjacent to and installed parallel to a flooring surface. The thickness of wall portion 240 preferably tapers towards an edge 260. The thickness of toe portion 250 preferably tapers towards an edge 270.

Figure 5:
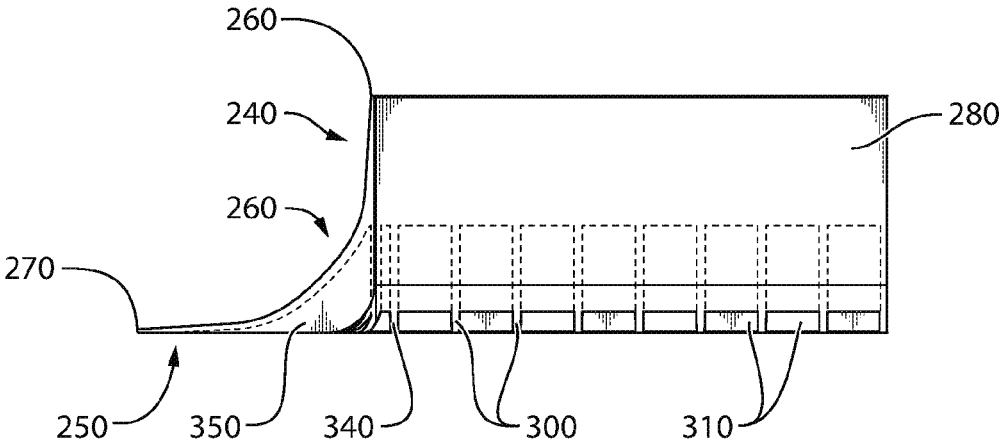
FIG. 5 is a rear perspective view of one outside corner cove base support section of FIG. 4.
Figure 6:
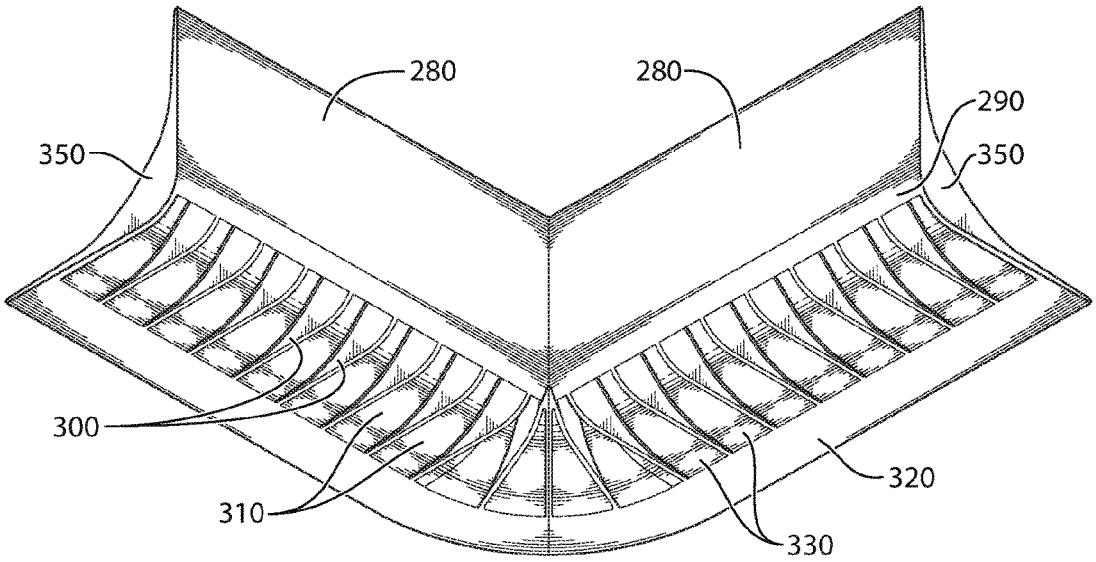
FIG. 6 is an angled bottom rear perspective view of the outside corner cove base support of FIG. 4.
Figure 7:
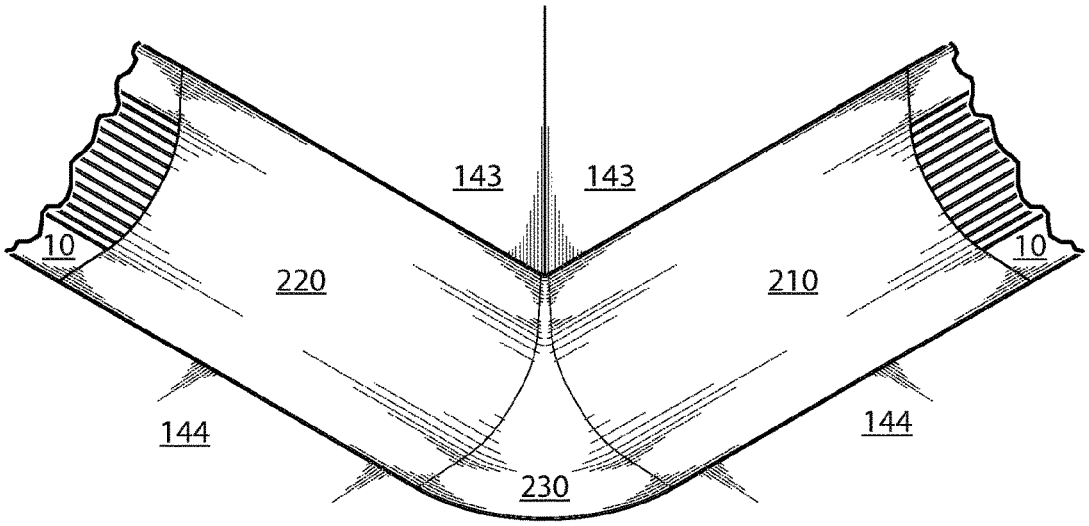
FIG. 7 is a perspective view of a combination of an outside corner cove base support of FIG. 4 and a cove base support of FIG. 1.

Each wall portion 240 has a substantially planar outside surface 280 facing the wall-floor interface when installed. Outside surface 280 cooperatively connects with rounded outside surface 290 of cove portion 260. A plurality of spaced apart ribs 300 disposed perpendicular to toe portion 250 between the inner and outer surfaces of cove portion 260, form channel segments 310. The ends of channel segments 310 on wall portion 240 are depicted in FIG. 5 by dashed lines. Ribs 300 and channel segments 310 extend within the toe portion towards a substantially planar surface 320 proximate toe portion edge 270. The edges 330 of ribs 300 define a portion of bottom surface 340 of toe portion 250. A rib 300 forms a closed end wall 350 at each end of corner cove support 200. The section profile of end walls 350 are similarly dimensioned to and cooperate with the ends of cove base support 10 permitting cove base supports 10 to be joined to each end wall 350 by adhesive or other suitable bonding means.

Corner cove base support 200 may be molded as a single piece or be fabricated in sections joined to form a complete corner section. Corner cove base support 200 may be constructed from material selected from the group consisting of PVC, ABS, polypropylene, high density propylene, and polystyrene.

For inside corners of a wall-floor interface, cove base support 10 may be mitred cut using conventional tools. Resilient floor sheeting 145 is installed against a mitred inside corner to form corner cove flashings using known cutting and installation means.

In some configurations, the outer surface of a cove flashing with the cove base described above may not align flush against a door moulding or a moulded wall opening. The protrusion of the cove flashing from the wall surface can result in objects being caught which may damage the cove flashing.

FIGS. 8, 9, 10, 11, and 12 depict a transition cove base support 400 that may be used in combination with cove base support 10. Transition cove base support 400 comprises a wall portion 410, a toe portion 420 and an intermediate curved or concave cove portion 430. The wall portion 410 is substantially perpendicular to the toe portion 420. The wall portion 410 is installed parallel to a wall surface and the toe portion 420 is adjacent and installed parallel to a flooring surface. The thickness of wall portion 410 preferably tapers towards an edge 430. The thickness of toe portion 420 preferably tapers towards an edge 440. Transition cove base support 400 is adapted to join a length of cove base support 10 at end 450 and to abut an access opening molding such as a vertical door molding 460 at opposite end 470. The end of toe portion 420 is angled from end 450 towards opposite end 470 forming a diminished inner surface 435 of intermediate section 430 along the length of transition cove base support 400.

Figure 8:
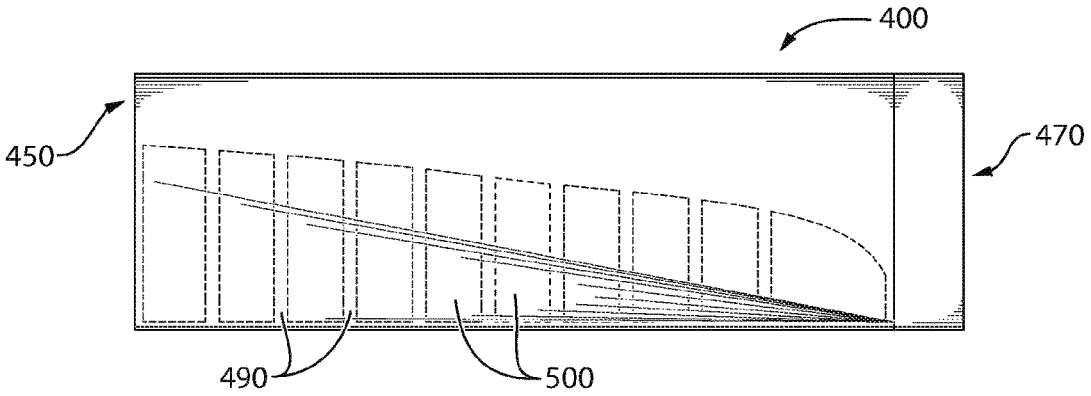
FIG. 8 is a front perspective view of a transitional variant of the cove base support.
Figure 9:
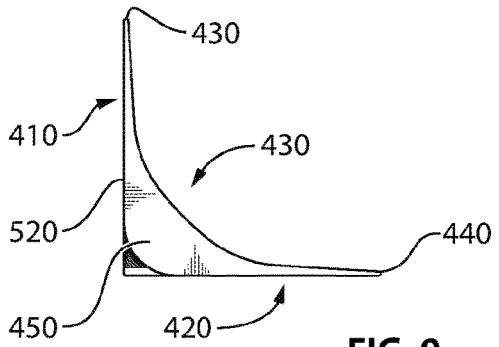
FIG. 9 is a cross section end view of the transition cove base support in FIG. 8.
Figure 10:
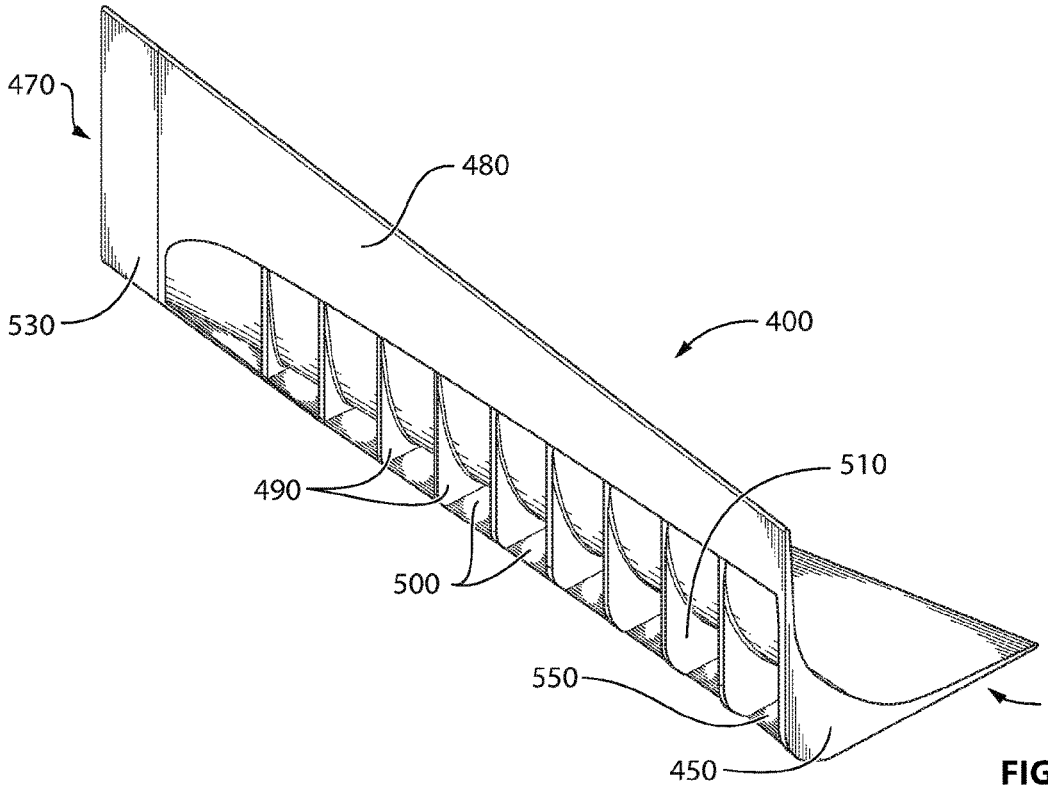
FIG. 10 is a rear perspective view of the transition cove base support in FIG. 8.
Figure 11:
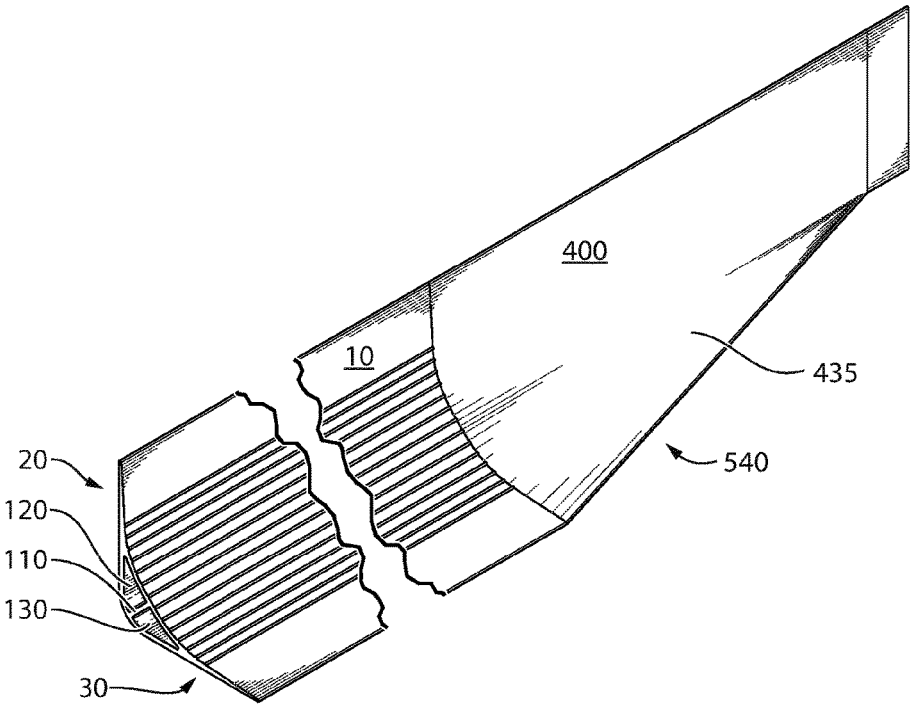
FIG. 11 is an angled perspective view of a fragmented section of a cove base support in FIG. 1 in combination with a transition cove base support of FIG. 8.
Figure 12:
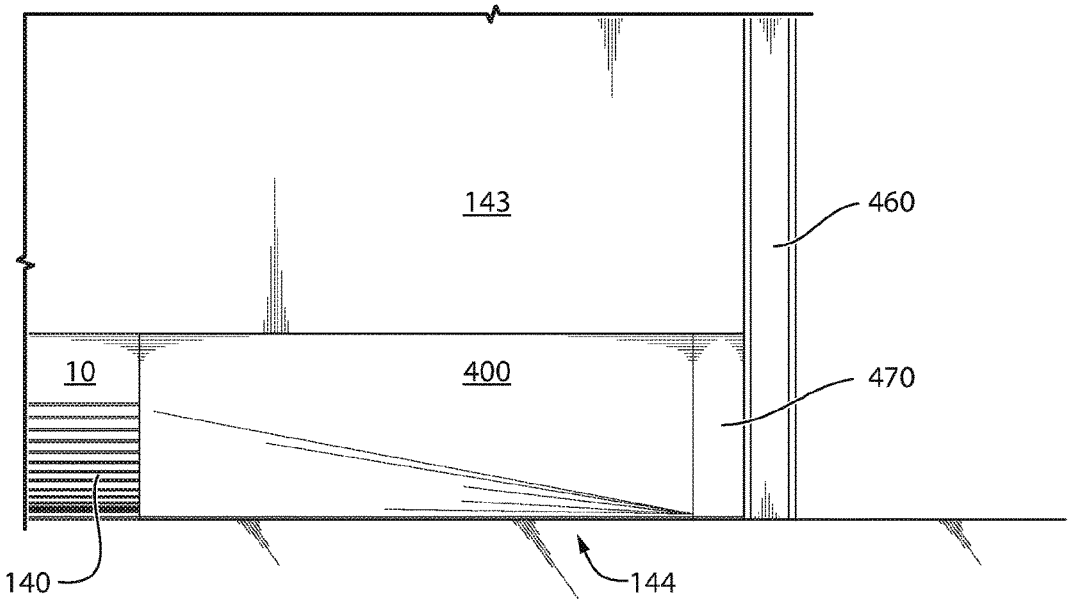
FIG. 12 is front view of a fragmented section of a cove base support of FIG. 1 in combination with a transition cove base support of FIG. 8 where transition base support abuts a door frame molding.

Wall portion 410 of transition cove base support 400 has a substantially planar upper outside surface 480 cooperating with a plurality of spaced apart rounded ribs 490 defining channel segments 500. The ends of channel segments 500 on wall portion 410 are depicted in FIG. 8 by dashed lines. The edges 510 of ribs 490 define a portion of outside surface 520 of wall portion 410. Ribs 490 become progressively shorter in height from end 450 towards a planar surface section 530 of end 470. Toe portion 420 has an angled substantially planar outside surface 540 cooperatively connected to curved cove surface 550 and cooperating with ribs 490. The bottom edges 560 of ribs 490 define a portion of bottom surface 540 of toe portion 420. A rib 490 forms end 450. The section profile of end wall 450 is are similarly dimensioned to and cooperates with the end of a cove base support 10 permitting cove base supports 10 to be joined to transition by adhesive or other suitable bonding means.

Transition cove base support 400 may be molded in various lengths but is preferably used in 6 inch to 12 inch lengths. Transition cove base support 400 may be constructed from material selected from the group consisting of PVC, ABS, polypropylene, high density propylene, and polystyrene.

The foregoing descriptions of embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A cove base support comprising a wall portion tapering to an uppermost edge, the wall portion having a planar outer surface extending vertically downwardly from the upper edge thereof, a toe portion tapering to an inner edge, the toe portion having a planar outer surface extending horizontally outwardly from the innermost edge thereof, the planar outer surface of the toe portion extending perpendicularly with respect to the planar outer surface of the wall portion, and a curved intermediate cove portion operatively connecting the wall portion to the toe portion, wherein the curved intermediate cove portion comprises a curved outer wall, a curved inner wall that is spaced apart from the curved outer wall to form an interior channel, and a longitudinally extending member cooperatively connecting the outer and inner walls to form an open web structure.

2. The cove base support of claim 1 further comprising a plurality of longitudinal ridges on inner surfaces of the wall portion, the toe portion, and the curved intermediate cove portion.

3. The cove base support of claim 1 constructed from material selected from the group consisting of PVC, ABS, polypropylene, high density propylene, and polystyrene.

4. The cove base support of claim 1 wherein the support is fabricated by extrusion.

5. An elongate extruded polymeric cove base support of uniform cross-section, the support to be installed where a floor meets a wall and comprising:

a wall portion tapering to an uppermost edge for attachment to a wall adjacent a floor, the wall portion having a planar outer surface extending vertically downwardly from the uppermost edge thereof, a toe portion tapering to an innermost edge for attachment to the floor adjacent the wall, the toe portion having a planar outer surface extending horizontally outwardly from the innermost edge thereof, the planar outer surface of the toe portion extending perpendicularly with respect to the planar outer surface of the wall portion, and a curved intermediate cove portion operatively connecting the wall and toe portions, the intermediate cove portion having a curved outer wall, a curved inner wall that is spaced apart from the outer wall, and a longitudinally extending member cooperatively connecting the outer wall and the inner wall to form an open web structure.

6. A cove base support comprising a wall portion tapering to an edge, a toe portion tapering to an edge, and a curved intermediate cove portion operatively connecting the wall portion to the toe portion, wherein the curved intermediate cove portion comprises a curved outer wall, a curved inner wall that is spaced apart from the curved outer wall to form an interior channel, and a longitudinally extending member cooperatively connecting the outer and inner walls to form an open web structure, and further comprising a contoured outside corner section adapted to cooperatively join two lengths of the cove base support at an outside corner and the corner section comprising:

a first body, a second body that is perpendicular to and operatively connected to the first body, each of the first and second bodies having a wall portion tapering to an edge, a toe portion tapering to an edge and an intermediate curved cove portion, the wall portion having a substantially planar outside surface operatively connected to a curved outside surface of the cove portion, and a plurality of spaced apart ribs disposed perpendicular to the toe portion between inner surfaces of the inner and outer walls of the cove portion and between the inner and outer walls of the toe portion to define interior channel segments, wherein outside edges of the ribs in the toe portion form part of the outside surface of the toe portion.

7. The cove base support of claim 6 wherein the corner section includes a plurality of longitudinal ridges on inner surfaces of the wall, toe, and cove portions.

8. The cove base support of claim 6 wherein the outside corner section is fabricated as a single molded section.

9. The cove base support of claim 6 wherein the outside corner section is constructed from material selected from the group consisting of PVC, ABS, polypropylene, high density propylene, and polystyrene.

10. A cove base support comprising a wall portion tapering to an edge, a toe portion tapering to an edge, and a curved intermediate cove portion operatively connecting the wall portion to the toe portion, wherein the curved intermediate cove portion comprises a curved outer wall, a curved inner wall that is spaced apart from the curved outer wall to form an interior channel, and a longitudinally extending member cooperatively connecting the outer and inner walls to form an open web structure, and further including a contoured end section adapted to cooperatively join a length of the cove base support and form a transition with a vertical opening, and the end section comprising;

a wall portion, a toe portion and an intermediate cove portion, the wall portion having a substantially planar upper outside surface cooperating with a plurality of spaced apart ribs disposed perpendicular to the toe portion between interior surfaces of inner and outer walls of the cove portion and between inner and outer walls of the wall portion to define interior channel segments, wherein outside edges of said ribs in the wall portion form part of the outside surface of the wall portion, and wherein the wall of the toe portion is dimensioned to form an angled edge relative to the intermediate cove portion from the end adjoining the cove base support to the end adjoining the vertical opening.

11. The cove base support of claim 10 wherein the end section has an end wall portion adjacent the vertical opening comprising a substantially planar outside surface devoid of ribs and channel segments.

12. The cove base support of claim 10, wherein the ribs disposed proximate to the end adjoining the cove base support have a greater vertical height dimension than the ribs disposed proximate the opposite end of the end section.

13. The cove base support of claim 10, wherein the end section includes a plurality of longitudinal ridges on inner surfaces of said wall, toe, and cove portions.

14. The cove base support of claim 10 wherein the end section is fabricated as a molded section.

15. The cove base support of claim 10 wherein the end section is constructed from material selected from the group consisting of PVC, ABS, polypropylene, high density propylene, and polystyrene.

16. A cove base support comprising a wall portion, a toe portion, a curved intermediate cove portion operatively connecting the wall portion to the toe portion and comprising an open web structure;

a contoured end section adapted to cooperatively join a length of the cove base support and to form a transition with a vertical opening, the end section comprising;

a wall portion, a toe portion and an intermediate cove portion, the wall portion having a substantially planar upper outside surface cooperating with a plurality of spaced apart ribs disposed perpendicular to the toe portion between inner and outer walls of the cove portion and inner and outer walls of the wall portion to define interior channel segments, wherein outside edges of said ribs in the wall portion form part of the outside surface of the wall portion, and wherein the wall of the toe portion is dimensioned to form an angled edge relative to the intermediate cove portion from the contoured end section adjoining the cove base support to the end adjoining the vertical opening.

17. The cove base support of claim 16, wherein the end section has an end wall portion adjacent the vertical opening, the end wall portion comprising a substantially planar outside surface devoid of ribs and channel segments.

18. The cove base support of claim 16, wherein ribs disposed proximate to an end of the end section adjoining the cove base support have a greater vertical height dimension than ribs disposed proximate an opposite end of the end section.

19. The cove base support of claim 16, wherein the end section includes a plurality of longitudinal ridges on inner surfaces of said wall, toe, and cove portions.

20. The cove base support of claim 16, wherein the end section is fabricated as a molded section.

* * * * *